US006412656B1

(12) United States Patent
Placik

(10) Patent No.: US 6,412,656 B1
(45) Date of Patent: Jul. 2, 2002

(54) MOISTENED WIPE DISPENSER

(76) Inventor: Lora Placik, 2612 Kingston Rd., Northbrook, IL (US) 60062

( * ) Notice: Subject to any disclaimer, the term of this patent is extended or adjusted under 35 U.S.C. 154(b) by 0 days.

(21) Appl. No.: 09/712,490

(22) Filed: Nov. 14, 2000

(51) Int. Cl.[7] ..... B65H 1/00
(52) U.S. Cl. ..... 221/33; 221/63
(58) Field of Search ..... 221/33, 63; 206/210, 206/484, 449, 812, 823, 804, 815

(56) References Cited

U.S. PATENT DOCUMENTS

| | | | | | |
|---|---|---|---|---|---|
| 2,279,658 | A | | 4/1942 | Crebbs | |
| 3,072,304 | A | | 1/1963 | Junaid | |
| 3,197,062 | A | | 7/1965 | Day et al. | |
| 3,224,633 | A | | 12/1965 | Allen | |
| 3,456,844 | A | * | 7/1969 | Planner | 221/63 X |
| 3,580,427 | A | | 5/1971 | Clarke | |
| 3,819,043 | A | | 6/1974 | Harrison | |
| 3,836,044 | A | | 9/1974 | Tilp et al. | |
| 4,180,160 | A | * | 12/1979 | Ogawa et al. | 221/63 X |
| 4,185,754 | A | | 1/1980 | Julius | |
| 4,262,816 | A | * | 4/1981 | Marguiles | 221/46 X |
| 4,526,296 | A | | 7/1985 | Berger et al. | |
| 4,535,912 | A | * | 8/1985 | Bonk | 221/46 X |
| 4,722,462 | A | | 2/1988 | Zinnbauer | |
| 4,784,290 | A | | 11/1988 | Howard | |
| 4,863,064 | A | | 9/1989 | Dailey, III | |
| 5,379,897 | A | | 1/1995 | Muckenfuhs et al. | |
| 5,582,294 | A | | 12/1996 | Yamada | |
| 5,791,465 | A | | 8/1998 | Niki et al. | |
| 5,908,138 | A | | 6/1999 | Vlahakis et al. | |
| 5,911,338 | A | | 6/1999 | Miller | |
| 5,975,411 | A | | 11/1999 | Windolph, III | |
| 6,047,848 | A | | 4/2000 | Davis | |
| 6,053,357 | A | | 4/2000 | Yoh | |
| 6,170,698 | B1 | * | 1/2001 | Phelps et al. | 221/45 X |

* cited by examiner

*Primary Examiner*—Christopher P. Ellis
*Assistant Examiner*—Gene O. Crawford
(74) *Attorney, Agent, or Firm*—Seyfarth Shaw

(57) ABSTRACT

A dispenser for pre-moistened wipes has a moisture-impermeable housing containing a supply of pre-moistened wipes and having a dispensing wall. A flexible and resilient bulbous dispensing structure is carried by the dispensing wall and projects outwardly therefrom in use so as to be manually squeezable by a user to open normally-closed slits therein to define an opening permitting removal of wipes from the housing. The dispensing structure may define a nose portion of housing indicia depicting a face. In one embodiment, the housing is in the form of a bag which is initially vacuumed sealed, drawing the dispensing structure into the bag to present a substantially flat dispensing wall to facilitate stacking of plural dispensers, the dispensing structures assuming its normal use position when the interior of the housing is exposed to atmospheric pressure. The wipes may be designed for safe use on babies and are moistened with an appropriate fluid.

19 Claims, 2 Drawing Sheets

FIG. 4
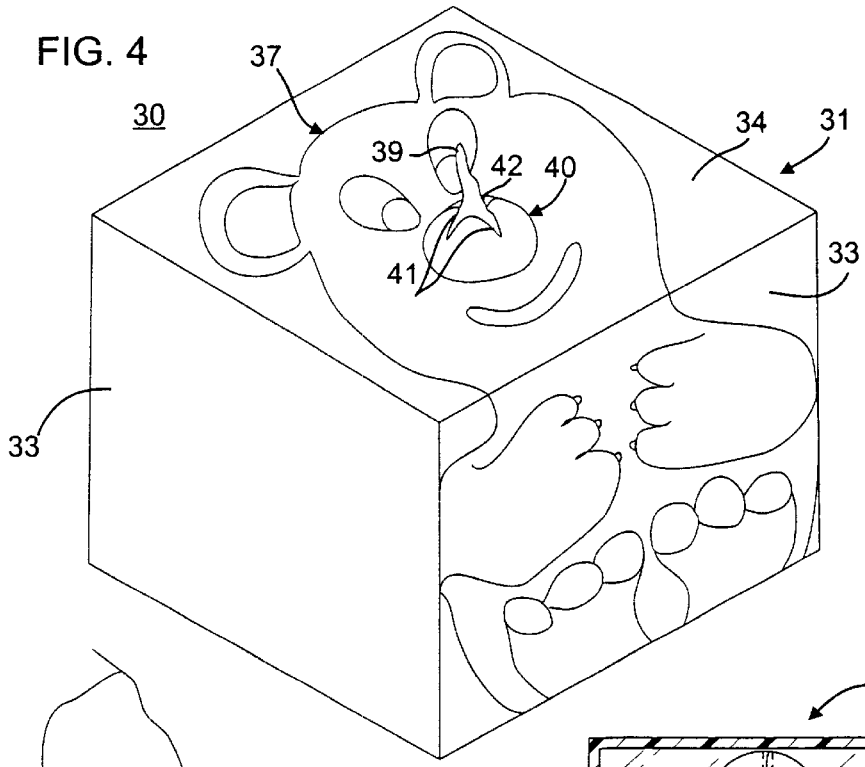
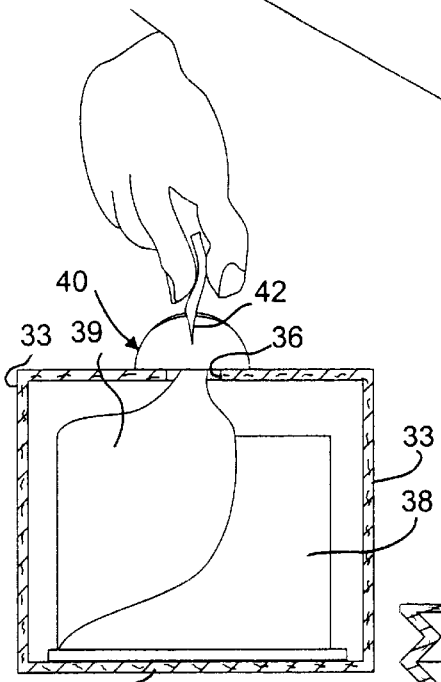
FIG. 5
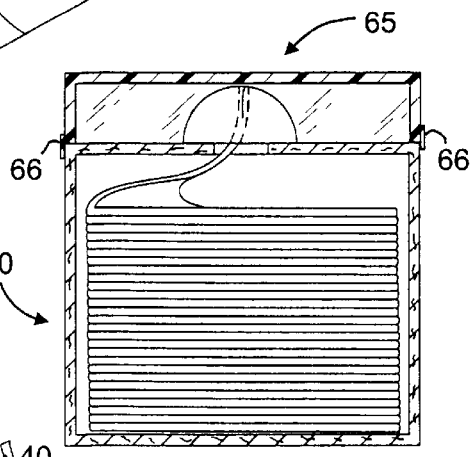
FIG. 7
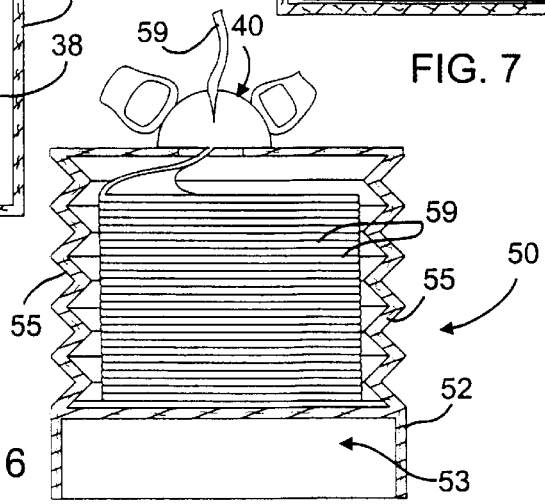
FIG. 6

MOISTENED WIPE DISPENSER

BACKGROUND

Various types of pre-moistened wipes, towelettes and the like have heretofore been provided in a number of different types of packages, including boxes, canisters, and the like. Typically, in such prior dispensers, there is a dispensing opening which can be covered by a reclosable lid or the like and provides access to the wipes. Typically, the wipes are in the form of sheets of material interconnected or inter-engaged within the housing so that, as one wipe sheet is withdrawn, it can be torn from, or automatically becomes disconnected from the leading edge of, the next wipe sheet which remains projecting a slight distance from the dispensing opening to facilitate access by the next user.

However, heretofore, such dispensers have not been specifically designed for use on babies or small children.

SUMMARY

Accordingly, there is disclosed in this application a dispenser for pre-moistened wipes which is specifically designed for use on or in connection with babies or small children.

An important aspect is the provision of a dispenser of the type set forth, which is designed to be attractive to and entertaining for such babies or small children.

Still another aspect is the provision of a dispenser of the type set forth which can be easily stackable with other like dispensers, for storage, display and the like.

Certain ones of these and other aspects may be achieved by providing a moisture-impermeable housing containing a supply of pre-moistened wipes and having a dispensing wall, a flexible and resilient dispensing structure carried by the dispensing wall and disposable in a use position projecting outwardly from the dispensing wall in a convex bulbous shape, the dispensing structure having a normally-closed slit therein and being squeezable in its use position to open the slit to define an opening permitting removal of wipes from the housing.

BRIEF DESCRIPTION OF THE INVENTION

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

FIG. 4 is a perspective view of a dispenser in accordance with another embodiment;

FIG. 5 is a reduced view in vertical section of the dispenser of FIG. 4, illustrating its use;

FIG. 6 is a view similar to FIG. 5 of another embodiment; and

FIG. 7 is a view similar to FIG. 5 of yet another embodiment.

DETAILED DESCRIPTION

Figure 1:
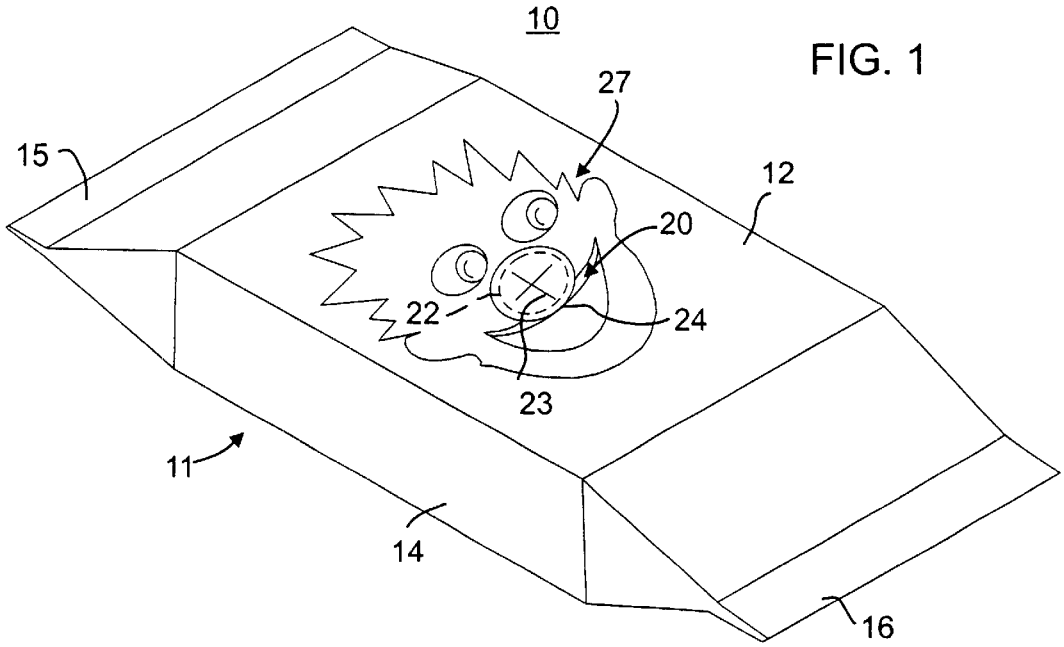
FIG. 1 is a perspective view of a moistened wipe dispenser in accordance with an embodiment of the invention.
Figure 2:
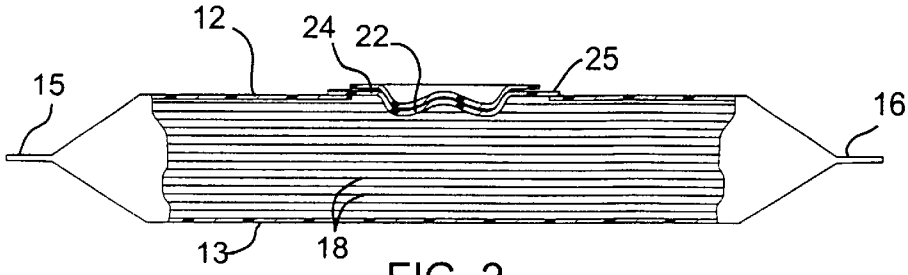
FIG. 2 is a reduced side elevational view of the dispenser of FIG. 1, with portions broken away more clearly to show the internal construction.
Figure 3:
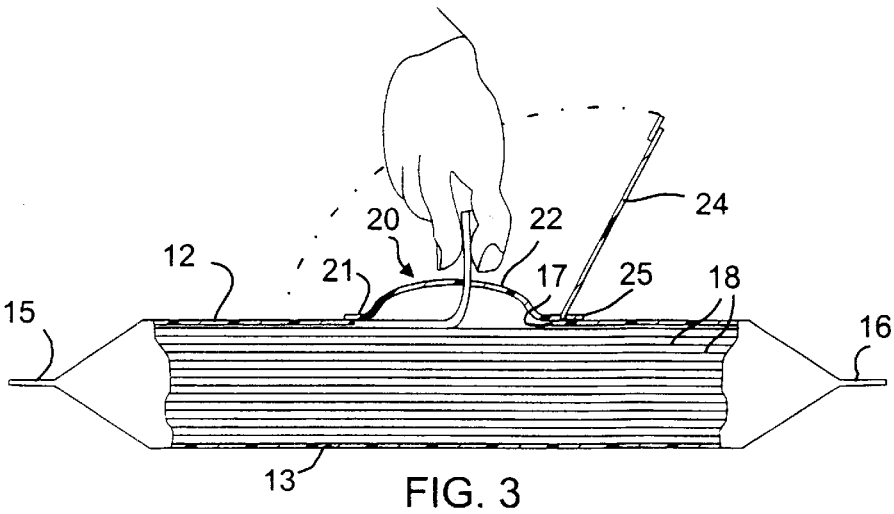
FIG. 3 is a view similar to FIG. 2, with the dispenser unsealed in a use position.

Referring to FIGS. 1–3, there is illustrated a dispenser, generally designated by the numeral 10, which includes a housing 11 in the nature a soft bag having a top or dispensing wall 12, a bottom wall 12, opposed side walls 14 and crimped and sealed ends 15 and 16. Formed in the top wall 12 is a dispensing aperture 17, which may be generally circular in shape, and provides access to the interior of the housing 11, in which is stored a supply 18 of pre-moistened wipes 19. The wipes are in the form of individual wipe sheets 19 which may be folded in such a way as to be inter-engaged so that, upon removal of a top wipe sheet 19, the leading end of the immediately underlying wipe sheet will be brought into the aperture 17 for ready access by the user, all in a known manner.

Carried by the top wall 12 is a dispensing structure formed of a flexible and resilient material, such as a suitable plastic, and being pre-molded so as to have a normal rest condition which projects outwardly in a convex, bulbous shape, as illustrated in FIG. 3. The dispensing structure 20 may be circular in shape and has a perimeter 21 adapted to be fixedly secured, by suitable means, to the top wall 12 of the housing 11 around the perimeter of the aperture 17. The dispensing structure 20 has a central bulbous portion 22 provided with one or more slits 23 therein, which may include a pair of perpendicularly crossed slits. Also fixedly secured to the perimeter 21 of the dispensing structure 20 along one side thereof is a seal flap 24, which may be hingedly attached so as to be movable between a sealed condition illustrated in FIG. 2 and an open condition illustrated in FIG. 3. The flap 24 may be formed of a suitable plastic material and may be transparent. Formed on the outer surface of the housing 11, and particularly along the top wall 12 thereof, is a decorative indicia 27, preferably in the form of a depiction of a face, such as a clown face, animal face or the like, so arranged that the dispensing structure 20 defines the nose of the face.

Initially, when the housing 11 is filled and sealed, the seal flap 24 covers the dispensing structure 20 and is sealed around the perimeter thereof and the interior of the housing 11 is then placed under a vacuum, which will tend to draw the flexible and resilient dispensing structure 20 inwardly, as illustrated in FIG. 2, flattening it out in a pre-use condition so as to facilitate stacking of another dispenser 10 on the top wall 12 of another such dispenser. When a user wishes to make a first use of the dispenser 10, the seal flap 24 is unsealed and peeled back to its open condition illustrated in FIG. 3, thereby exposing the interior of the housing 1 1 to atmospheric pressures, since the slits 23, while in a normal closed condition, are not airtight. Upon equalization of the pressures inside and outside of the housing 11, the dispensing structure 20 pops back up to its normal use position, illustrated in FIG. 3. When the sides of the dispensing structure 20 are manually squeezed (see FIG. 6), the slits 23 open, to define an access opening facilitating removal of the topmost wipe sheet 19 from the dispenser 10. If desired, the seal flap 24 may be provided around its perimeter with a reclosable or resealable adhesive so that the dispensing structure 20 can be recovered when not in use. Because of the flexible, soft nature of the housing 11, it will automatically collapse as the contents thereof are removed.

The housing 11 may be formed of any suitable material, such as a suitable plastic film or a coated paper, so as to the substantially moisture impermeable. The wipe sheets 18 are pre-moistened with suitable fluids, which may include saline, petroleum jelly, or other fluids which are useful for safely wiping the skin of any portion of the bodies of babies or small children, including hypoallergic fluids such as hyaluronic acid. The nose formed by the dispensing structure and the indicia surrounding it are designed to be attractive to babies or small children, tending to make the dispenser 10 an entertaining and non-threatened object.

Referring now to FIGS. 4 and 5, there is illustrated another dispenser, generally designated by the numeral 30, which includes a generally box-like housing 31, which may be formed of cardboard, paperboard or other suitable materials which have sufficient rigidity as to retain a box-like shape. The housing 31 has a bottom wall 32, four upstanding sidewalls 33 and a top or dispensing wall 34, the latter having formed therein a small circular aperture 36. Formed on the outer surface of the housing 31 are decorative indicia, which may be in the form of a depiction of a person or animal, so arranged that the face is displayed on the top wall 34. Disposed within the housing 31 is a supply of pre-moistened wipes, which may be in the form of a roll 38 of interconnected sheets 39, which may be joined by rows of perforations, in a known manner, so as to facilitate separation of one sheet from another. Mounted on the top wall 34 is a dispensing structure 40, which may be substantially the same as the dispensing structure 20, described above, and is centered over the aperture 36. The dispensing structure 40 has slits 41 therethrough which are openable to define a 4-armed dispensing opening 42, in response to squeezing of the dispensing structure 40 by a user. While the housing 31 is illustrated containing a roll of wipe sheets, it could be provided with a stack of inter-engaged sheets, as in the dispenser 10 of FIGS. 1–3.

Referring to FIG. 6, there is illustrated an alternative form of dispenser 50, which is similar to the dispenser 30, except that the housing is provided with a depending skirt 52 which extends downwardly from the bottom wall and has an open bottom to define a false-bottom cavity 53. The cavity 53 is so dimensioned that it will receive the dispensing structure 40 when one dispenser 50 is stacked atop another, thereby facilitating such stacking. The dispenser 50 may have accordion-pleated side walls 55 so that the housing will automatically collapse as the contents are removed therefrom. In this case, the dispenser 50 is shown with a stack of individual wipe sheets 59 arranged therein.

Referring to FIG. 7, there is illustrated another dispenser 60, which is similar to the dispenser 30, except that it contains a stack of individual wipe sheets and it is provided with a removable cover 65, which may be formed of a suitable plastic material, preferably transparent to permit viewing of the indicia 37 therethrough. The cover 65 is generally in the shape of a shallow, open-bottom box, dimensioned to accommodate the dispensing structure 40 therein, and which may be provided with suitable latch structure 66 to retain it in place. The cover 65 facilitates stacking of the dispenser 60.

While the false-bottom cavity 53, the accordion-pleated side walls 55 and the cover 65 have been shown in specific embodiments, it will be appreciated that any of these features could be used in any of the embodiments of FIGS. 4–7.

From the foregoing, it can be seen that there is provided an improved dispenser for pre-moistened wipes which is specially designed for use on, and to be attractive and entertaining to, babies or small children.

The matter set forth in the foregoing description and accompanying drawings is offered by way of illustration only and not as a limitation. While particular embodiments have been shown and described, it will be obvious to those skilled in the art that changes and modifications may be made without departing from the broader aspects of applicant's contribution. The actual scope of the protection sought is intended to be defined in the following claims when viewed in their proper perspective based on the prior art.

I claim:

1. A dispenser for pre-moistened wipes comprising:

a moisture-impermeable housing containing a supply of pre-moistened wipes and having a dispensing wall, a flexible and resilient dispensing stricture carried by the dispensing wall and disposable in a use position projecting outwardly from the dispensing wall in a convex bulbous shape and exposed so as to be easily grasped by a user, the dispensing structure having a normally-closed slit therein and being squeezable in its use position to open the slit to define an opening permitting removal of wipes from the housing.

2. The dispenser of claim 1, wherein the supply of wipes includes a plurality of individual sheets stacked in the housing so that removal of a first sheet will draw a leading portion of a following sheet into the opening.

3. The dispenser of claim 1, wherein the supply of wipes is in the form of a roll of sheets separated by rows of perforations to facilitate separation of the sheets from one another.

4. The dispenser of claim 1, wherein the wipes are designed for use on babies or small children and are pre-moistened with a moistening agent safe for use on babies and small children.

5. The dispenser of claim 1, and further comprising a seal mechanism for initially sealing the dispensing structure in a pre-use condition.

6. The dispenser of claim 1, wherein the dispensing structure has a pair of crossed slits therein.

7. The dispenser of claim 1, wherein the housing is collapsible.

8. The dispenser of claim 7, wherein the housing is in the form of a sealed bag.

9. The dispenser of claim 7, wherein the housing is in the form of a box having accordion-pleated side walls.

10. The dispenser of claim 1, wherein the housing is in the form of a box.

11. The dispenser of claim 10 and further comprising an open-bottom, box-like cover removably connectable to the housing and dimensioned to cover the dispensing structure when not in use and to provide a flat surface to facilitate stacking of plural dispensers, the dispensing wall being a top wall of the box.

12. The dispenser of claim 10, wherein the dispensing wall is a top wall of the box, the box having a bottom wall and a peripheral skirt depending therefrom for cooperation therewith to define a false bottom of a depth sufficient to accommodate the dispensing structure when the one box is stacked atop another.

13. A dispenser for pre-moistened wipes comprising:

a vacuum-sealed housing containing a supply of pre-moistened wipes and having a dispensing wall, a flexible and resilient dispensing structure carried by the dispensing wall and disposable, when the interior of the housing is exposed to atmospheric pressure, in a use position projecting outwardly from the dispensing wall in a convex bulbous shape and exposed so as to be easily grasped by a user, and a seal initially covering the dispensing structure for maintaining the vacuum in the housing to withdraw the dispensing structure into the housing in a pre-use condition, the seal being removable to expose the interior of the housing to atmospheric pressure, the dispensing structure having a normally-closed slit therein and being squeezable in its use position to open the slit to define an opening permitting the removal of wipes from the housing.

14. The dispenser of claim 13, wherein the housing is in the form of a sealed bag.

15. The dispenser of claim 13, wherein the supply of wipes includes a plurality of individual sheets stacked in the housing so that removal of a first sheet will draw a leading portion of a following sheet into the opening.

16. The dispenser of claim 13, wherein the wipes are moistened with a moistening agent including hyaluronic acid.

17. The dispenser of claim 13, wherein the seal includes a flexible flap.

18. The dispenser of claim 17, wherein the flap is formed of a transparent material.

19. A dispenser for pre-moistened wipes comprising:

a vacuum-sealed housing containing a supply of pre-moistened wipes and having a dispensing wall, a flexible and resilient dispensing structure carried by the dispensing wall and disposable, when the interior of the housing is exposed to atmospheric pressure, in a use position projecting outwardly from the dispensing wall in a convex bulbous shape, and a seal including a flexible transparent flap initially covering the dispensing structure for maintaining the vacuum in the housing to withdraw the dispensing structure into the housing in a pre-use condition, the seal being removable to expose the interior of the housing to atmospheric pressure, the dispensing structure having a normally-closed slit therein and being squeezable in its use position to open the slit to define an opening permitting the removal of wipes from the housing, the seal including a resealable adhesive so that the dispensing structure can be recovered after it is initially exposed.

* * * * *